US006684598B1

(12) United States Patent
Fostervold

(10) Patent No.: US 6,684,598 B1
(45) Date of Patent: Feb. 3, 2004

(54) INSULATING WINDOW AND PROFILE MATERIAL THEREFOR

(76) Inventor: Öystein Fostervold, Churchills vei 13b, N-7058, Jakobsli (NO)

( * ) Notice: Subject to any disclaimer, the term of this patent is extended or adjusted under 35 U.S.C. 154(b) by 0 days.

(21) Appl. No.: 09/701,569

(22) PCT Filed: Jun. 7, 1999

(86) PCT No.: PCT/NO99/00188

§ 371 (c)(1),
(2), (4) Date: Dec. 8, 2000

(87) PCT Pub. No.: WO99/66162

PCT Pub. Date: Dec. 23, 1999

(30) Foreign Application Priority Data

Jun. 8, 1998 (NO) ..... 19982615

(51) Int. Cl.[7] ..... E04C 2/54

(52) U.S. Cl. ..... 52/786.13; 52/172; 52/204.595; 52/204.6; 52/204.62; 52/204.68

(58) Field of Search ..... 52/204.6, 204.62, 52/172, 475.1, 204.595, 204.593, 204.591, 204.67, 204.68, 786.13

(56) References Cited

U.S. PATENT DOCUMENTS

| | | | | |
|---|---|---|---|---|
| 3,928,953 A | * | 12/1975 | Mazzoni et al. | 52/172 |
| 4,027,443 A | * | 6/1977 | Briggs | 52/202 |
| 4,080,482 A | * | 3/1978 | Lacombe | 428/34 Q |
| 4,109,432 A | | 8/1978 | Pilz | |
| 4,719,728 A | * | 1/1988 | Eriksson et al. | 52/172 |
| 4,811,532 A | | 3/1989 | Fratti et al. | |
| 4,984,402 A | * | 1/1991 | Davies | 52/398 |
| 6,055,783 A | * | 5/2000 | Guhl et al. | 52/204.62 |

FOREIGN PATENT DOCUMENTS

| | | |
|---|---|---|
| CH | 633607 | 12/1982 |
| WO | 9616245 | 5/1996 |
| WO | 9809043 | 3/1998 |

* cited by examiner

*Primary Examiner*—Carl D. Friedman
*Assistant Examiner*—Yvonne M. Horton
(74) *Attorney, Agent, or Firm*—Dennison, Schultz & Dougherty

(57) ABSTRACT

A thermally insulating window is provided having at least two glass panes having a space therebetween and at least one frame-shaped spacing member secured to the at least two glass panes within that space.

5 Claims, 1 Drawing Sheet

INSULATING WINDOW AND PROFILE MATERIAL THEREFOR

BACKGROUND OF THE INVENTION

The present invention relates to a profile for a spacing member as found in a thermally insulating window with two or more panes of glass, and a window incorporating the profile member.

It is well known to assemble a thermally insulating window by joining two panes of glass with an intermediate spacing member. Such spacing members require that the spaced apart panes of glass are arranged in a mounting, e.g. a wooden frame or a frame made of metal or plastic material. The spaced apart panes of glass will be sensitive to impact and need mechanical reinforcements along their edges for attachment of hinges and other fittings such as catches.

Norwegian patent No. 115 035 (Aspaas) teaches the manufacture of a thermally insulating window with a recess along its edge for mounting in a frame of ribs protruding into the recess from all sides. This mounting requires that a glass pane can be adjusted in its plane in order to be mounted in, or released from, the frame. It is not possible to make a firm assembly with screws or the like. Attachment with adhesives will create problems for any replacement.

German laid open publication No. 15 09 224 and No. 16 59 468 (Bayer) and other publications, describe the manufacture of a thermally insulating window with a closed, tube shaped duct in the connecting profile which holds the glass panes together. This duct is, however, not intended for mounting with screws. Thus, these known thermally insulating windows are not suitable for mounting, e.g. with hinges, without a separate frame.

Norwegian Patent 97 332 (Aluco) describes a U-shaped profile for joining two panes of glass to a thermally insulating window pane, but it provides no possibility of detached mounting, attachment of hinges or the like.

The main objective of the present invention is to provide a thermally insulating window pane including at least two panes of glass, which can be used with relative freedom and which does not require any special framing.

It is a particular object to provide a thermally insulating window which allows a direct attachment with superfluous additional elements, like a frame or covering elements or the like. It is a further objective to provide a window that can be hinged without a frame, that can be used as a sash window without any particular framing, and which may easily be replaced by loosening attachment screws.

SUMMARY OF THE INVENTION

The present invention is principally defined by the claims 1 and 5, whereas the claims 2–4 describes preferred embodiments of the invention.

The attachment wall which is arranged within the U-shaped profile, and preferably, but not necessarily, at a small distance from the outer edge, will provide a basis for screws for attachment of the thermally insulating window, which does not need to be furnished with any (further) frame. Since the attachment web is arranged in close proximity to the bottom wall and the inner wall, these will constitute a rigid unit, so that the inner part of the profile is able to partially pick up the moments that arise when forces are to be transferred from the screws to the thermally insulating window.

The positioning of the inner attachment wall will provide a recess which makes room for a supporting rib from a surrounding structure, should that be desirable.

BRIEF DESCRIPTION OF THE DRAWINGS

The invention will be further described by reference to the accompanying drawings where.

DETAILED DESCRIPTION OF THE DRAWING

Figure 1:
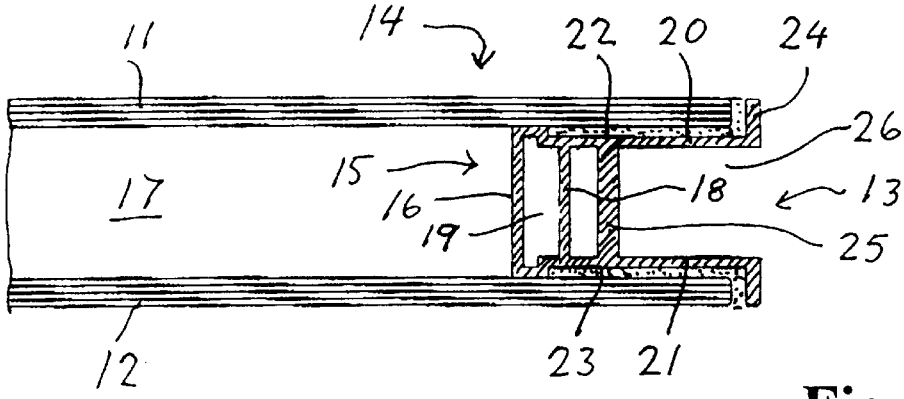
FIG. 1 shows a section through a spacing member according to a first embodiment of the invention.

FIG. 1 shows two glass panes 11 and 12 which are joined by a frame-shaped spacing member 13 to form a thermally insulating window 14. The spacing member 13 is formed by a profile of extruded aluminum with a substantially U-shaped cross section, with an inner web 15 which has a bottom wall 16 facing the space 17 between the glass panes 11, 12 and an internal wall 18 arranged at a distance from the inner web 15, forming a space 19 for drying agent arranged to absorb condensated water through the perforation of the wall towards the inner space 17 of the thermally insulating window.

The spacing member 13 has two parallel flanges or legs 20, 21 to which the glass panes 11, 12 are attached by means of strips of adhesive tapes 22, 23 of a convenient material. The legs 20, 21 have outwards extending flanges 24 which cover the edges of the glass panes.

Figure 3:
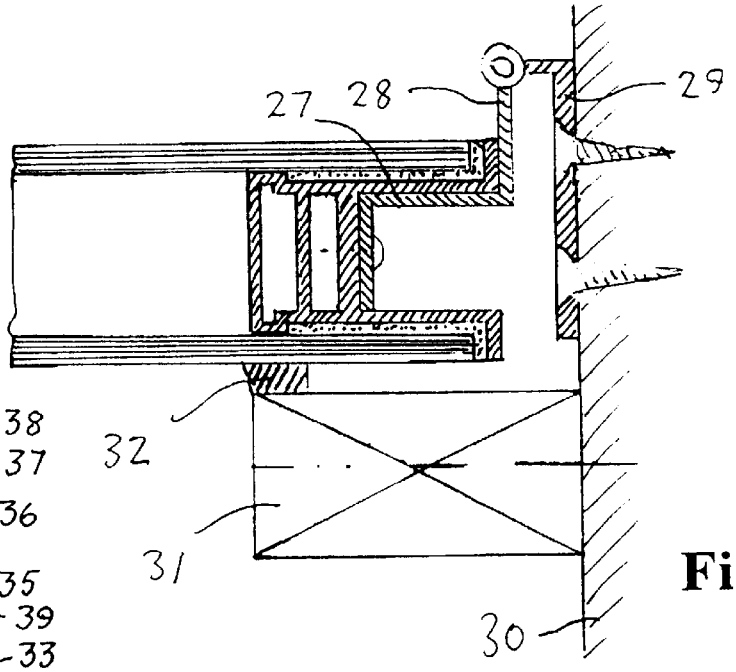
FIG. 3 shows a section through a hinged window according to the invention.

Adjacent to the internal wall 18 is arranged an attachment wall or screw attachment rib 25 intended for the insertion of a screw for the attachment of the thermally insulating window 14, e.g. as shown in FIG. 3, to an outer structure. In the example according to FIG. 1 the outer part of the legs 20, 21 form there between a recess 26 which gives support for an attachment profile as further described below.

A thermally insulating window 14 as herein described can withstand great physical strain, substantially more than the presently available thermally insulating windows. The flanges 24 make the thermally insulating window easier to handle with less risk for damage.

Figure 2:
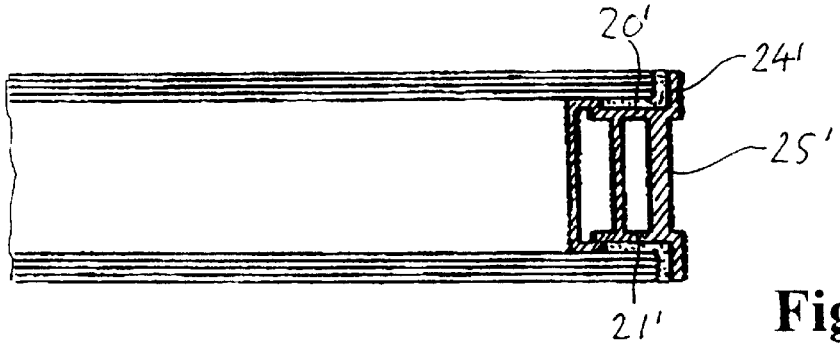
FIG. 2 shows a modified embodiment of the spacing member compared to the embodiment of FIG. 1.

FIG. 2 shows an alternative embodiment where the length of the legs 20, 21 outside of the attachment wall 25 is almost nothing, so that the attachment wall 25' is arranged very close to the flanges 24'.

The attachment wall or screw attachment rib 25 provides options for attachment of the thermally insulating window in several ways that have not been possible with presently available windows. Such a possibility is shown in FIG. 3. Here an L-profile 27 is inserted into the recess 26, the L-profile forming part (28) of a hinge, where the other part 29 of the hinge may be attached to a support 30, e.g. a window frame, by means of screws. In order to form an abutment and a sealing against the thermally insulating window 14, the window frame 30 may be provided with a frame-shaped member 31 furnished with a seal 32 that the thermally insulating window can rest against. The foregoing provides a very simple construction with minimal material use and easy assembly. In addition, such a design will be easy to maintain, e.g. with respect to replacement of the seal 32 on member 31.

A thermally insulating window as described in the example may be used for many purposes where permanent or movable/displaceable window elements are required, for instance as traditional windows and sliding doors or as glass walls on balconies etc.

Figure 4:
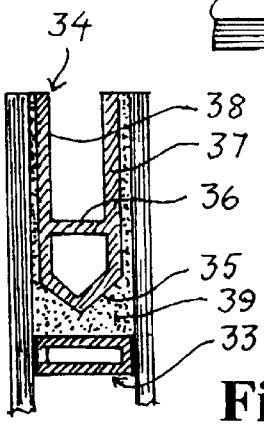
FIG. 4 shows a cross-sectional view of the second representative embodiment of the spacing member.

In a modified embodiment of the invention, each aluminium profile may be assembled from two parts, an inner tube-shaped part and an outer part forming the recess, where the two parts may be assembled by use of adhesive means. In FIG. 4 is illustrated an embodiment with an inner spacing member 33 consisting of a tube with rectangular crossection, being attached with a butyl tape on each side, and an outer spacing member 34 with a V-shaped front wall 35 which is turned inwards in the completed thermal insulating window pane, with an attachment wall 36 and two extending legs 37, 38 which are terminated with straight ends. Such a two-part spacing member will provide advantages for the manufacturing process and in addition provide an advantage when assembly is performed with a two component silicone based adhesive- and sealing member 39. The front wall 35 will ensure that air is squeezed out completely and that a compact sealing member is obtained.

What is claimed is:

1. A thermally insulating window, comprising:

at least two glass panes having a space therebetween;

at least one frame-shaped spacing member disposed within said space and adhesively secured to said at least two glass panes, said spacing member having a bottom wall and an internal wall creating a circumferential channel therebetween;

said spacing member further includes a longitudinally and transversely extending attachment wall configured and dimensioned so that said internal wall is disposed between said attachment wall and said bottom wall, wherein said thermally insulating window is secured to a carrying structure by a plurality of screw means through said attachment wall;

said spacing member further comprises two parallel legs providing an intermediate recess for receiving mounting elements connecting said thermally insulating window to said carrying structure; and, wherein at least one of said two parallel legs of said spacing member extends to abut an edge of one of said glass panes.

2. A thermally insulating window according to claim 1, wherein said circumferential channel of said spacing member communicates with the space between said glass panes.

3. A thermally insulating window according to claim 1, wherein said circumferential channel is tubular.

4. A thermally insulating window according to claim 1, wherein said attachment wall is integral with said internal wall and said bottom wall.

5. A thermally insulating window according to claim 1, wherein said attachment wall is not integral with said internal wall and said bottom wall.

* * * * *